United States Patent [19]

Blazek

[11] 4,224,976

[45] Sep. 30, 1980

[54] METHOD OF ASSEMBLING MOLDS

[75] Inventor: William S. Blazek, Valley City, Ohio

[73] Assignee: TRW Inc., Cleveland, Ohio

[21] Appl. No.: 869,219

[22] Filed: Jan. 13, 1978

[51] Int. Cl.[3] ..... B22D 23/00; B22D 33/04

[52] U.S. Cl. ..... 164/4; 164/6; 164/23; 164/137; 164/339; 249/157

[58] Field of Search ..... 164/4, 6, 17, 23–26, 164/27, 137, 339, 341; 249/155, 157

[56] References Cited

U.S. PATENT DOCUMENTS

| | | | |
|---|---|---|---|
| 2,787,814 | 4/1957 | Milligan | 164/339 |
| 3,136,001 | 6/1964 | Gelbard | 249/155 |
| 3,669,177 | 6/1972 | Ingalls et al. | 164/26 |
| 4,048,709 | 9/1977 | Deem | 164/4 X |
| 4,066,116 | 1/1978 | Blazek et al. | 164/137 X |

FOREIGN PATENT DOCUMENTS

| | | | |
|---|---|---|---|
| 176854 | 5/1935 | Switzerland | 249/157 |

*Primary Examiner*—Robert L. Spruill
*Assistant Examiner*—Gus T. Hampilos

[57] ABSTRACT

An improved method of assembling molds enables the size of successive molds to be adjusted to provide cast articles having a desired size. In practicing the method, a first or initial mold is assembled in a fixture. This initial mold is used to form a cast article. The cast article formed in the initial mold is measured to determine the extent to which the dimensions of the article deviate from predetermined design dimensions. The fixture is then adjusted to compensate for the deviations in the dimensions of the cast article from the intended or design dimensions. A second mold is then assembled in the fixture. Since the fixture has been adjusted to compensate for the inaccuracies in the first mold, a product cast with the second mold will have dimensions closer to the desired dimensions.

31 Claims, 8 Drawing Figures

METHOD OF ASSEMBLING MOLDS

BACKGROUND OF THE INVENTION

This invention relates to a new and improved method of assembling molds and more particularly to a method of assembling molds by using a fixture to position mold sections relative to each other during the forming of a mold.

Circular turbine engine components have frequently been cast from one piece ceramic molds. The molds have been formed by using wax patterns which are covered with a wet coating of ceramic mold material. The wet covering of ceramic mold material is dried and fired at a relatively high temperature to eliminate the way pattern and fire the ceramic mold material to form a rigid mold. One known method of making turbine engine components in this manner is disclosed in U.S. Pat. No. 3,669,177.

When this known method of forming engine turbine components is utilized, the dimensions of the cast components may differ from the design or intended dimensions due to inaccuracies in the forming of the mold. Although there are many different factors which contribute to inaccuracies in the formation of the mold, shrinkage of the wax pattern, dimensional changes in the ceramic mold during drying and firing, and shrinkage of the casting material upon cooling all contribute to dimensional inaccuracies in the final cast product.

There are several known ways of compensating for the inaccuracies in the cast product. One of these is to form the cast product oversize and then machine it down to the desired dimensions. Another way of compensating for inaccuracies in the cast product is to change the metal dies used in forming the wax pattern. Both of these methods of compensating for dimensional inaccuracies in a cast product are expensive and time consuming.

SUMMARY OF THE PRESENT INVENTION

The present invention provides a new and improved method of assembling molds by utilizing a fixture to locate sections of the mold relative to each other. The fixture is utilized to position sections of a first mold relative to each other. After a product has been cast in this first mold, the product is measured to determine if its dimensions correspond to the design or desired dimensions. Assuming that there is a deviation from the desired dimensions, the fixture is adjusted to compensate for the difference between the actual dimensions of the product cast from the first mold and the desired dimensions. A second mold is then formed in the fixture. Since the fixture has been adjusted to compensate for the deviations in the first product from the desired dimensions, the product cast from the second mold will be closer to the desired dimensions.

The adjustable mold fixture includes a plurality of upstanding pin members which are disposed in a circular array on a base. The pin members are rotatable about axes which are offset from the central axes of the pin members. By rotating the pin members around the offset axes, the positions of the pin members are adjusted. The upper or free end portions of the pin members are utilized to support the wall sections of the mold. Although it is believed that the use of the upstanding pin members to support the wall section of the mold is advantageous since it provides access to the lower or bottom portion of the mold walls, it is contemplated that the mold walls could be mounted on adjustable members other than upstanding pin members.

Accordingly, it is an object of the present invention to provide a new and improved method of making mold assemblies and wherein mold wall sections are assembled on a fixture which is adjustable to compensate for deviations in the dimensions of a cast product from a desired set of dimensions.

Another object of this invention is to provide a mold fixture having a plurality of members which support the mold wall sections and are movable relative to a base to adjust the position of the mold wall sections relative to each other to thereby obtain a mold cavity of a desired size.

Another object of this invention is to provide a new and improved method of assembling a mold and wherein mold wall sections are supported on upstanding pin members which are rotatable about axes offset from the central axes of the pin members to adjust the positions of the mold wall sections relative to a base.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
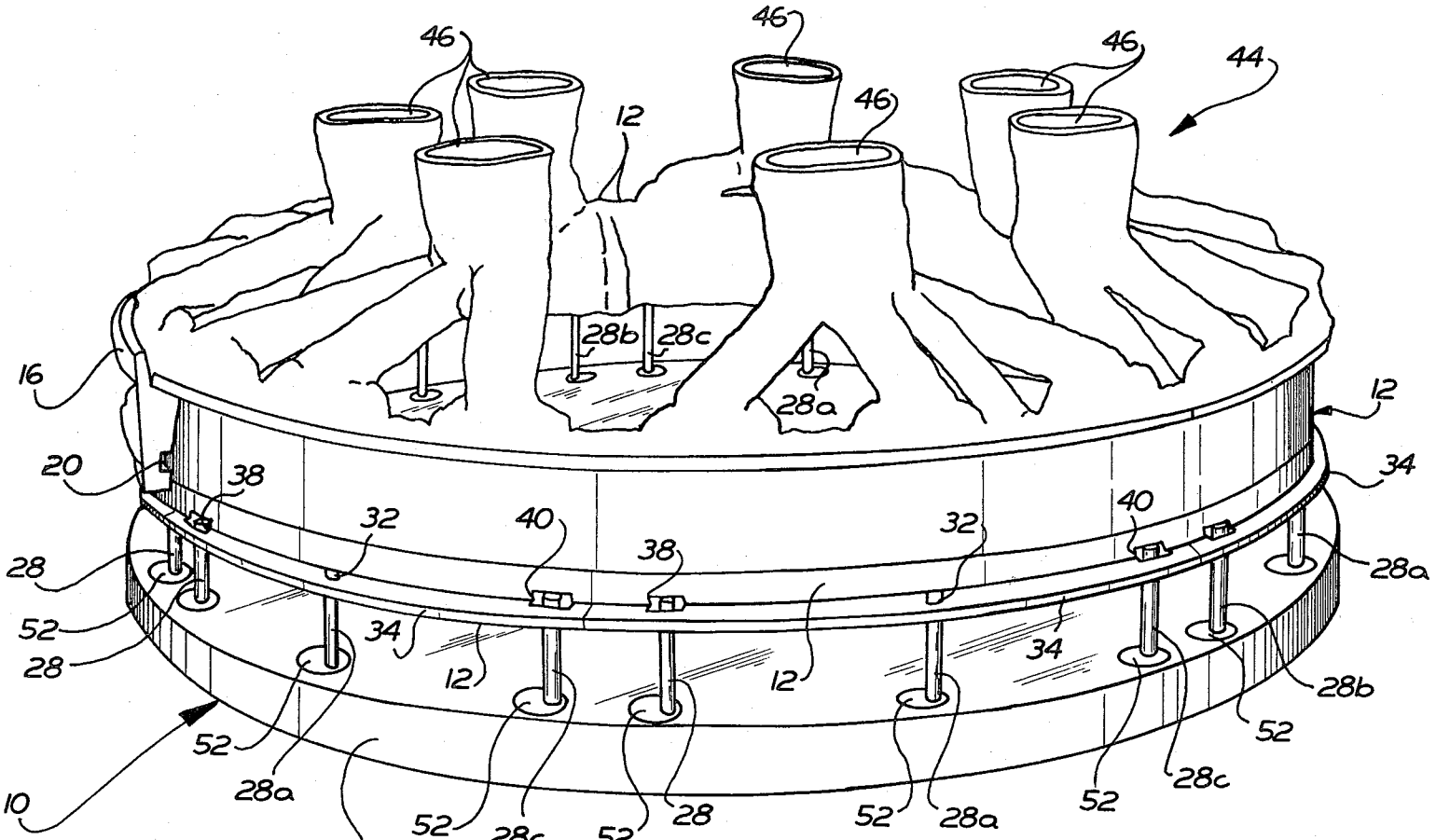
FIG. 1 is a pictorial illustration depicting the manner in which a plurality of mold wall sections are held in an adjustable mold fixture.
Figure 2:
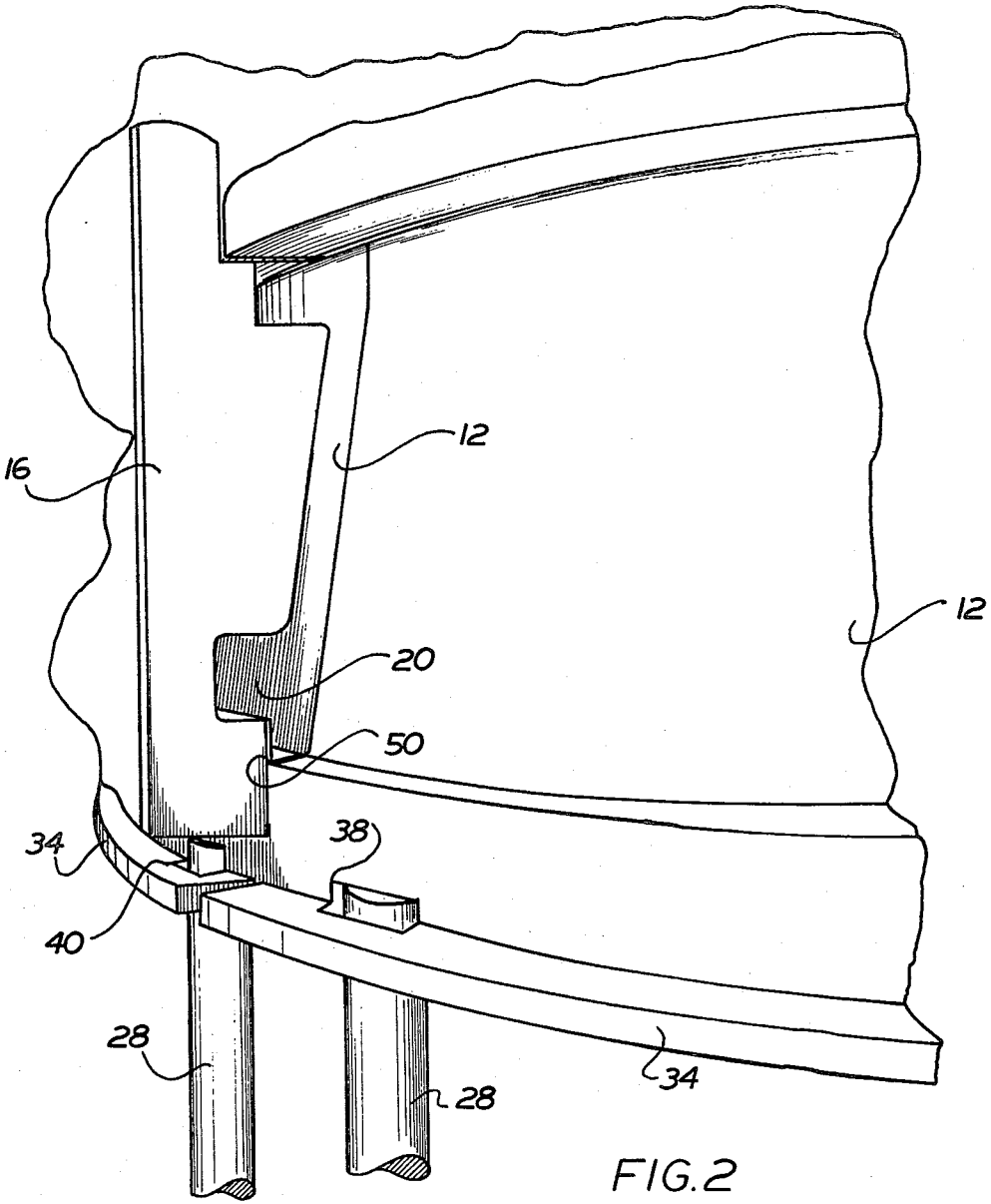
FIG. 2 is an enlarged pictorial illustration depicting the relationship between a plurality of mold wall sections and the upper end portions of upstanding support pins which are utilized to support the mold wall sections.

A mold fixture 10 for positioning a plurality of radially inner mold wall sections 12 relative to each other in a circular array is illustrated in FIG. 1. After the radially inner mold wall sections 12 have been positioned in a circular array in the mold fixture 10, radially outer mold wall sections 16 are mounted in a circular array on the inner mold wall sections (see FIGS. 2 and 3). The inner and outer mold wall sections 12 and 16 cooperate to define an annular mold cavity 20 in which a turbine engine component such as a diffuser case, nozzle ring, bearing support or fan frame is cast.

After the inner and outer mold wall sections 12 and 16 have been interconnected on the mold fixture 10 to form a complete mold assembly, the mold assembly is packed in a suitable investing material to reduce heat loss and to hold the various sections of the mold assembly against movement relative to each other. After the mold assembly has been preheated, molten metal is poured into the mold cavity to form a cast article in a known manner. After the cast article has been removed from the mold assembly, it is measured to determine the extent to which the dimensions of the cast article deviate from the intended or design dimensions for the article.

Once the dimensional deviations of the cast article from the desired dimensions have been determined, the mold fixture 10 is adjusted to compensate for this deviation. After the mold fixture 10 has been adjusted, inner and outer mold wall sections 12 and 16 are again assembled in the mold fixture 10. The resulting mold assembly is then used to form a second cast product in the same manner as previously explained in connection with the original mold assembly.

The second-to-be-cast article will have dimensions which are closer to the design or desired dimensions. This is because the mold fixture 10 is adjusted to compensate for the dimensional deviations of the first cast product from the design dimensions. It should be noted that the mold fixture 10 is left at the setting which was used to arrange the mold wall sections for the first mold assembly until the extent of the errors in the first cast product have been determined. The mold fixture is then adjusted from a position corresponding to this known product to a position compensating for the errors in the known product.

The mold sections 12 and 16 are made by dipping wax patterns in a slurry of liquid ceramic mold material. To make the wax patterns, suitable metal dies are provided. The dies have a side surface with a configuration corresponding to the inner side surface of the mold cavity 20 and an opposite side surface corresponding to the radially outer surface of the mold cavity 20. These die surfaces are used to form major side surfaces of the wax pattern. The two side surface areas on the wax pattern are separated by a wiping surface which does not have a configuration corresponding to any part of the mold sections 12 and 16. It should be understood that the patterns could be formed of a material other than natural wax. For example, a suitable synthetic wax of a plastic pattern material such as polystyrene could be utilized if desired.

The wax pattern is repetitively dipped in a liquid slurry of ceramic mold material. Although many different types of slurry could be utilized, one illustrative slurry contains fused silica, zircon, and other refractory materials in combination with binders. Chemical binders such as ethyl silicate, sodium silicate and colloidal silica can be utilized. In addition, the slurry may contain suitable film formers such as alginates to control viscosity and wetting agents to control the flow characteristics and pattern wettability.

In accordance with well known procedures, the pattern is repetitively dipped and dried enough times to build up a covering of mold material of a desired thickness. After each dipping of the pattern in the liquid ceramic mold material, the surface area of the pattern which does not correspond to any part of the mold sections 12 and 16 is wiped to remove the liquid ceramic mold material from this area. This results in the formation of a discontinuity in the coating of ceramic mold material overlying the pattern with one section of the coating corresponding to the radially inner mold wall section 12 and another section of the coating corresponding to the radially outer mold wall section 16. When the pattern and dried mold wall sections are fired at a relatively high temperature, the wax pattern melts and the two mold wall sections are readily separated due to the discontinuity formed in the pattern material at the wiping surface areas.

The manner in which the patterns are formed, dipped and wiped is the same as disclosed in U.S. Patent application Ser. No. 653,383 filed by Blazek et al on Jan. 29, 1976 and entitled "Mold Assembly and Method of Making the Same". Accordingly, the manner in which the ceramic mold wall sections 12 and 16 are formed will not be further described herein in order to avoid prolixity of description. However, it should be understood that other known methods could be utilized to form the ceramic mold wall sections 12 and 16.

The mold fixture 10 includes a circular base 24. A plurality of upstanding mold wall support pins 28 extend upwardly from the circular base 10 (see FIGS. 1 and 3). In the present instance, the arcuate inner and outer mold wall sections 12 and 16 cooperate to form a circular mold cavity 20. Therefore, the mold wall support pins 28 are arranged in a circular array about the base 24.

Although it is contemplated that any desired number of pins 28 could be utilized to support a particular mold wall section, in the present instance three pins 28 are utilized to support each of the inner mold wall sections 12. Therefore, the pins are disposed on the base 10 in groups of three pins 28*a*, 28*b* and 28*c*. Each group of three pins includes a center pins 28*a* which engages a hole 32 in the central portion of a bottom mold wall flange 34 (see FIG. 3). A slot 38 (see FIG. 1) in the mold wall flange 34 is engaged by one side support pin 28*b*. A second slot 40 in the bottom flange 34 of the mold wall section 12 is engaged by a third support pin 28*c*.

In the mold 44 shown in a partially assembled state in FIG. 1, seven radially inner mold wall sections 12 are interconnected in a circular array. Therefore, there are seven groups of three support pins 28*a*, 28*b* and 28*c*, arranged in a circular array on the base 24. It should be noted that a pour cup 46 is connected with passages leading to each of the inner mold wall sections 12 to provide for an even distribution of metal about the annular mold cavity 20 (see FIG. 3).

The inner mold wall sections 12 are interconnected at flanges formed at the ends of the mold wall sections. In one specific instance, spring loaded jaw clamps were utilized to engage the flanges formed on the end portions of adjacent mold wall sections to hold them together. In addition, a suitable cement is used at the flange joints to interconnect the inner mold wall sections 12 and seal the joints.

Once the inner mold wall sections 12 have been interconnected, the arcuate outer mold wall sections 16 are mounted on the inner mold wall sections 12. Each of the outer mold wall sections 16 is connected with the inner mold wall sections 12 by a suitable ceramic cement (see FIGS. 2 and 3). In the illustrated mold 44, the outer mold wall secton 16 have an accurate extent which is the same as the arcuate extent of the inner mold wall sections 12.

The outer mold wall sections 16 are provided with flanges at their end portions to enable the outer mold wall sections 16 to be interconnected in the same manner as previously explained in connection with the inner mold wall sections 12. This results in the formation of an annular mold cavity 20 between the inner and outer mold wall sections 12 and 16. The manner in which the mold wall sections 12 and 16 are interconnected with each other is the same as is disclosed in the aforementioned U.S. Patent application Ser. No. 653,383 filed by Blazek et al on Jan. 29, 1976.

After the mold wall sections 12 and 16 have been interconnected, the completed mold 44 is removed from the mold fixture 10. It should be noted that the positions of the mold wall support pins 28 are not changed as the completed mold 44 is removed from the fixture 10. The mold 44 is then packed in a suitable investing material. A first article is then cast in the mold cavity 20 by pouring molten metal into the pour cups 46.

Once the molten metal has solidified, the resulting cast article is removed from the mold 44. The cast article is then measured to determine if its dimensions are in accordance with the design dimensions for the article. It should be noted that the mold cavity 20 and the cast article both have relatively large diameters. Due to the difficulties inherent in accurately casting articles having large dimensions, in all probability the actual diameter of the article will differ slightly from the design diameter. This difference will be a result of pattern shrinkage, dimensional changes in the mold wall sections during drying, firing and pouring, and due to shrinkage of the metal in the annular mold cavity 20 as the molten metal cools.

Once the deviation of the diameter of the cast article from the desired diameter has been determined, the positions of the mold wall support pins 28 on the base 24 are adjusted to eliminate this dimensional error. It should be noted that the mold wall support pins are not moved from the positions in which they supported the inner mold wall sections 12 until after the first cast product has been measured. This enables the support pins to be moved from the positions in which the mold wall sections were interconnected to form a cast product having known dimensions.

Once the extent to which the initial cast product differs from the desired dimensions has been determined, the extent to which the positions of the inner mold wall sections 12 must be changed to provide a mold to form a cast product having the desired dimensions can be determined. To change the positions of the inner mold wall sections 12 during the assembly of a next succeeding mold 44, it is necessary to change the positions of the mold wall support pins 28.

Figure 3:
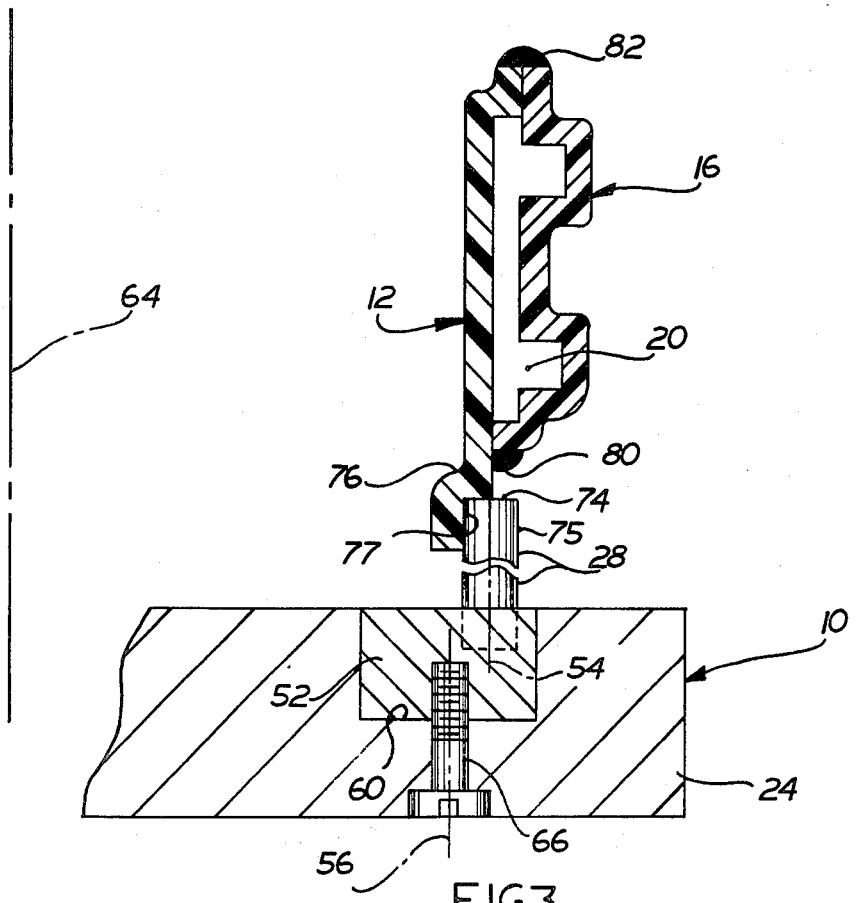
FIG. 3 is a somewhat schematicized fragmentary sectional view of a portion of the mold fixture and mold sections illustrated in FIG. 1.

In order to enable the position of the pins 28 to be adjusted, each of the pins is fixedly connected with a cylindrical eccentric member 52 (FIG. 3). The pins 28 have central axes 54 which are offset to one side of the central axes 56 of the eccentrics 52. The central axes 56 of the eccentrics 52 are coincident with the central axes of cylindrical recesses 60 in which the eccentrics are mounted. Therefore, upon rotation of the eccentrics 52 about their central axes 56, the pins 28 are rotated about the axes 56 with a resulting change in the position of the pins relative to a central axis 64 of the circular base 24.

Figure 4:
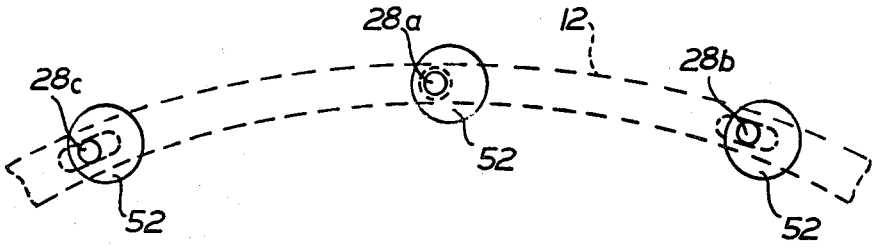
FIG. 4 is a schematic illustration of the manner in which a plurality of adjustable pins are utilized to support a mold wall section.
Figure 5:
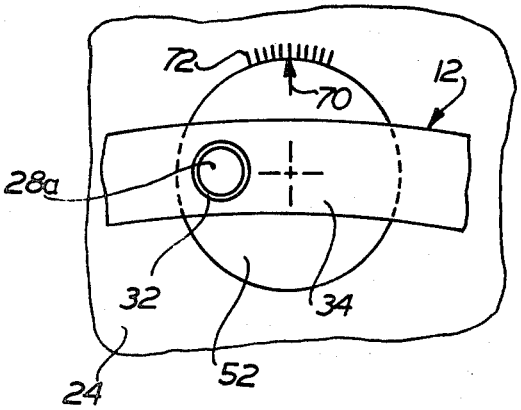
FIG. 5 is a fragmentary schematic illustration depicting the relationship between one of the support pins of the mold fixture and a central portion of a mold wall section.
Figure 6:
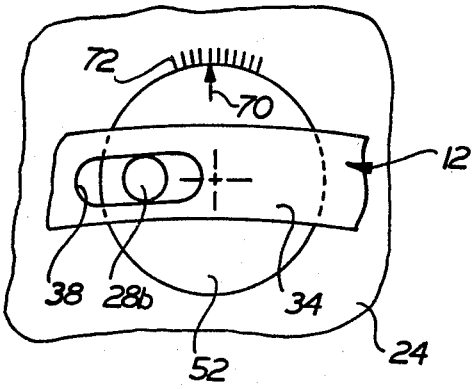
FIG. 6 is a schematic illustration, generally similar to FIG. 5, depicting the relationship between one of the adjustable support pins and a slot formed in an end portion of a mold wall section.
Figure 7:
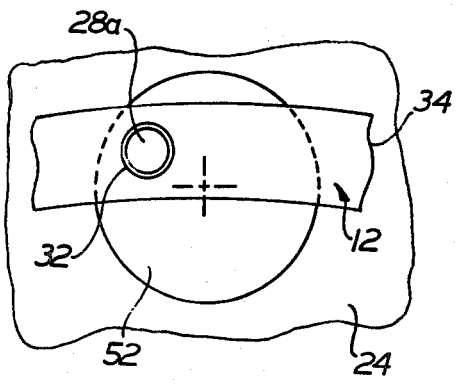
FIG. 7 is a schematic illustration of the support pin of FIG. 5 after it has been rotated about an axis which is offset to the central axis of the pin to adjust the position of the support pin and the mold wall section.

Assuming that the initial product cast using the mold 44 had a diameter which was somewhat undersize, for example sixty thousandths of an inch (0.060 inch) undersize, the eccentrics 52 would be rotated in a clockwise direction (as viewed in FIGS. 4, 5 and 6). This shifts the pins 28 outwardly from the initial positions shown in FIGS. 5 and 6 to adjusted positions shown in FIGS. 7 and 8. Of course the outward movement of the pins 28 results in an increase the diameter of the cylindrical array of support pins.

The adjustment of the eccentrics 52 is advantageously done before the inner mold wall sections 12 for the next succeeding mold are placed on the support pins. Thus, each of the eccentrics 56 is rotated in a clockwise direction (as viewed in FIG. 4) to move the central axis asssociated with a pin 28 radially outwardly from the central axis 64 of the support plate by a distance equal to one-half of the total error in the diameter of the cast product. In the example set forth in which the total error in the diameter of the cast product was sixty thousandths of an inch, each of the eccentrics 52 would be rotated to shift the central axis 54 of the associated pin 28 outwardly by thirty thousandths of an inch. Since this would be done for all of the pins 28, the diameter of the circular array of support pins would be increased by sixty thousandths of an inch to compensate for the error in the size of the initially cast product.

The eccentrics 52 for each of the support pins 28 is of the same construction and is held in an associated cavity 60 by a suitable screw or other type of fastener 66. When the eccentric 52 is to be rotated, the screw 66 is loosened and the eccentric rotated to the desired extent. The screw 66 is then tightened to lock the eccentric in place. In compensating for errors in the initially cast product, the eccentrics 52 for each of the support pins 28 is rotated through the same arcuate distance from the position in which it was disposed when the first mold was assembled. Therefore, the overall diameter of the mold cavity is modified by the same amount throughout the circumferential extent of the mold cavity.

The support pins **28*a* for the center of the inner mold wall sections 12 are received in circular holes 32 formed in the bottom flange 34 of the mold wall sections (see FIGS. 3 and 5). When the eccentric 52 for a center support pin 28*a* is rotated in a clockwise direction (as viewed in FIG. 5) the center of the pin 28*a* moves from the position shown in FIG. 5 to the position shown in FIG. 7. This results in the hole 32 in the center of the mold wall section 12 being displaced outwardly to an extent which corresponds to the arcuate extent of rotation of the eccentric 52**.

Although it is contemplated that the extent to which the eccentric 52 is rotated could be measured in various different ways, a pointer 70 is advantageously formed on the upper surface of the eccentric 52 and cooperates with a scale 72 formed in the top surface of the base 24. By providing identical scales 72 in association with pointers 70 on each of the eccentrics 52, rotation of each of the eccentrics through the same arcuate distance to adjust for errors in the size of an initial cast product is facilitated.

In addition to adjusting the position of the eccentric 52 on which the center support pin **28*a* is disposed, the eccentric 52 on which the end support pin 28*b* is disposed (see FIGS. 4 and 6) is also adjusted. The eccentric 52 on which the end support pin 28*b* is disposed is rotated through the same arcuate distance as the eccentric 52 on which the support pin 28*a* is located. This results in the support pin 28*b* being shifted from the position shown in FIG. 6** to the position shown in FIG.

8. It should be noted that although the center support pin 28*a* is received in a circular hole in the flange 34 of the mold section 12, the end support pin 28*b* is received in a slot 38 formed in the flange 34.

Figure 8:
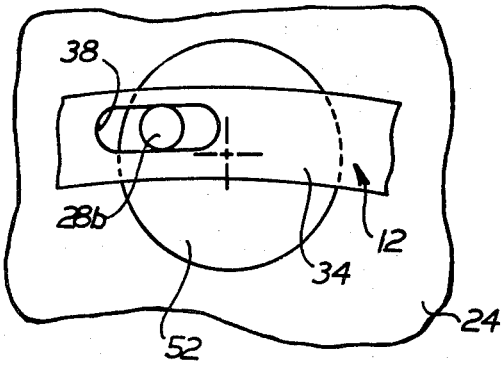
FIG. 8 is a schematic illustration of the support pin of FIG. 6 after the support pin has been rotated about an axis which is offset from the central axis of the support pin to adjust the position of the support pin.

Although only the relationship between the mold wall section 12 and the end support pin 28*b* is shown in FIGS. 6 and 8, the opposite end support pin 28*c* cooperates with a slot 40 in the mold wall section in the same manner as does the end support pin 28*b*. The position of the end support pin 28*c* is adjusted in the same manner as previously described for the support pins 28*a* and 28*b*. The mold section flange 34 has been illustrated in FIGS. 4–8 as having a cylindrical hole 32 for receiving the center support pin 28*a* and a pair of slots 38 and 40 for receiving the end support pins 28*b* and 28*c*, it is contemplated that the mold wall sections could be formed with other types of recesses to receive the support pins. For example, it is believed that a semicircular recess may be particularly advantageous.

Regardless of the shape of the recess in which the support pin is received, each of the support pins 28*a*, 28*b* and 28*c* abuts an accurately located downwardly facing support surface formed on the inside mold section 12. Thus, the circular top surface 74 of the support pin 28*a* abuts a semi-circular support surface 76 (see FIG. 3) formed on the inner mold wall section 12. In addition, a cylindrical side surface 75 of the support pin 28*a* abuts an arcuate side surface 77 of the recess in the inner mold wall section. The inner mold wall section 12 has locating surfaces similar to the locating surfaces 76 and 77 for engagement with the top and side surfaces of the support pins 28*b* and 28*c*.

Once the eccentrics 52 have been rotated and locked in place by the retaining screws 66 to thereby adjust the positions of the support pins 28, the inner mold wall sections 12 for the next mold are placed on the support pins. Due to the fact that the support pins 28 were moved outwardly to increase the diameter of the cast product by sixty thousandths of an inch, there will be a slight increase in the gap formed between the end flanges of the mold wall sections. This gap is filled with a suitable cement and the flanges held against movement relative to each other by spring clamps in the manner previously described.

The arc of curvature of the inner wall sections 12 is not changed even though the diameter of the circular array of support pins 28 is changed. This results in a slight scalloping or daisy effect. However, since the change in the diameter of the circular array of support pins is relatively small, this scalloping effect will be extremely small and will be within the tolerance ranges for most cast products.

In addition, the scalloping effect tends to be minimized when the mold is preheated immediately prior to casting. Even though the mold wall sections are formed of a ceramic material, the stresses in the mold wall sections are relaxed when the mold is heated to a relatively high temperature immediately before pouring of the molten metal in the mold. This relaxing of the tension or stresses in the mold wall sections minimizes the scalloping or daisy effect obtained by adjusting the position of the support pins 28.

Once the inner mold wall sections 12 have been mounted on the support pins 28, the outer mold wall sections 16 are mounted on the inner mold wall sections 12. The inner mold wall section could be formed with a support flange or shoulder which is engaged by a corresponding support flange or shoulder on the outer mold wall section 16. However, it is preferred to connect the outer mold wall section 16 with the inner mold wall section 12 by merely using cement along upper and lower joints 80 and 82 (see FIG. 3) between the inner and outer mold wall sections. It should be noted that access to the bottom of the mold wall sections is facilitated by the fact that the mold wall sections are supported above the base 24 on the support pins 28.

Once the second mold 44 has been constructed in the fixture 10, the second mold is removed from the fixture packed with a suitable investing material. After the mold has been preheated to the desired temperature, molten metal is poured into the mold to form a second cast product. After the casting is cooled, its dimensions are checked to determine if they correspond to the design dimensions. Of course, if there is still a slight error in the dimensions of the cast product, the positions of the support pins 28 can again be adjusted in the manner previously explained.

In the example previously set forth, the diameter of the cast product was slightly undersize so that the support pins 28 had to be moved outwardly to increase the diameter of the circular array of support pins and the mold cavity. It is contemplated that the diameter of the cast product may be oversize. In which case the eccentrics 52 would be rotated in the opposite direction, that is in a counterclockwise direction as viewed in FIGS. 5–8, to reduce the diameter of the circular array of support pins 28.

Reducing the diameter of the array of support pins 28 results in the end portions of the adjacent mold sections being moved toward each other. If each of the mold sections was formed so that the flanges at the end of the mold sections exactly abutted each other when the support pins 28 were initially set, it would be necessary to remove material from the flanges of the mold sections before they could be placed in a circular array having a smaller diameter. It is contemplated that decreasing the diameter of the circular array of mold wall sections 12 can be facilitated by forming the mold wall sections so that there is a slight gap between the flanges of the mold wall section when the pins 28 are set in their initial positions. Of course, this gap is filled with a suitable cement.

Although it is believed to be advantageous to support the mold sections 12 and 16 above the base 24 on the support pins 28 to provide access to the bottom of the mold sections, the mold sections could be positioned directly on the base plate 24 and the support pins 28 used primarily as locating pins to position the mold sections relative to the base 24. It is also contemplated that rather than using a plurality of separate support pins, each mold section may be supported on a single slide member which is movable relative to the base 24. In the illustrated mold 44 in which there are seven inner wall sections 12, it would be necessary to provide seven separate slides. Each of these slides would be individually movable toward and away from the central axis of the base 24 to vary the diameter of the circular array of mold sections supported on the slides.

It is believed that the use of a single support slide for each of the mold sections would facilitate adjustment of the setting of the mold fixture 10 after the mold wall sections 12 have been placed in the fixture. This is because only a single member or slide would have to be adjusted for each of the mold wall sections other than requiring the adjustment of three support pins 28*a*, 28*b* and 28*c*. Of course, the slides could be adjusted before the inner wall mold sections 12 are placed in the mold fixture 10 in the same manner in which the support pins 28 are adjusted. It should also be noted that although the support pins 28 have been used to directly support and locate the inner mold wall sections 12, the mold could be constructed in such a manner that the support pins 28 would engage the outer mold wall section 16 or both of the mold wall sections 12 and 16.

In view of the foregoing description it is apparent that the present invention provides a new and improved method of assembling molds 44 by utilizing a fixture 10 to locate sections 12 of the mold relative to each other. The fixture 10 is utilized to position sections of a first mold 44 relative to each other. After a product has been cast in this first mold, the product is measured to determine if its dimensions correspond to the design or desired dimensions. Assuming that there is a deviation from the desired dimensions, the fixture 10 is adjusted to compensate for the difference between the actual dimensions of the product cast from the first mold and the desired dimensions. A second mold is then formed in the fixture 10. Since the fixture has been adjusted to compensate for the deviations in the first product from the desired dimensions, the product cast from the second mold will be closer to the desired dimensions.

The adjustable mold fixture 10 includes a plurality of upstanding pin members 28 which are disposed in a circular array on a base 24. The pin members 28 are rotatable about axes 56 which are offset from the central axes 54 of the pin members. By rotating the pin members 28 around the offset axes 56, the positions of the pin members 28 are adjusted. The upper or free end portions of the pin members are utilized to support the wall sections 12 and 16 of the mold. Although it is believed that the use of the upstanding pin members 28 to support the wall section of the mold 44 is advantageous since it provides access to the lower or bottom portion of the mold walls, it is contemplated that the mold walls could be mounted on adjustable members other than upstanding pin members.

Having described a specific preferred embodiment of the invention, the following is claimed:

1. A method of assembling a plurality of molds to cast articles, said method comprising the steps of providing an adjustable mold fixture which is adapted to receive a plurality of mold wall sections, providing mold wall sections, placing a first plurality of the mold wall sections having predetermined mold cavity wall forming dimensions in the mold fixture to locate the first plurality of mold wall sections in a first spatial relationship relative to each other, interconnecting the first plurality of mold wall sections while they are in the mold fixture, removing the first plurality of mold wall sections from the mold fixture, casting a first article using the first plurality of mold wall sections, measuring the first article to determine the extent to which its dimensions deviate from predetermined dimensions, placing a second plurality of mold wall sections having the same predetermined mold cavity wall forming dimensions as corresponding first mold wall sections in the mold fixture to locate the second plurality of mold wall sections relative to each other, compensating for deviations in the dimensions of the first article from the predetermined dimensions by adjusting the mold fixture to locate the second plurality of mold sections relative to each other in a second spatial relationship which is different than the first spatial relationship, interconnecting the second plurality of mold wall sections while they are in the mold fixture and after adjusting the mold fixture to compensate for deviations in the dimensions of the first article, removing the second plurality of mold wall sections from the mold fixture, and casting a second article having at least slightly different dimensions than the first article by using the second plurality of mold wall sections.

2. A method as set forth in claim 1 wherein said step of adjusting the mold fixture is performed prior to the performance of said step of placing a second plurality of mold wall sections in the mold fixture.

3. A method as set forth in claim 1 wherein said step of placing the first plurality of mold wall sections in the mold fixture includes the step of locating the first plurality of mold wall sections in a circular array having a first diameter, said steps of placing a second plurality of mold wall sections in the mold fixture and adjusting the mold fixture include the step of locating the second plurality of mold wall sections in a second circular array having a second diameter which is different than said first diameter.

4. A method as set forth in claim 3 wherein said step of providing an adjustable mold fixture includes the step of providing a mold fixture having a plurality of mold wall locating surfaces which are disposed in a circular array, said step of adjusting the mold fixture including the step of changing the diameter of the circular array of mold wall locating surfaces.

5. A method as set forth in claim 4 wherein said step of changing the diameter of the circular array of mold wall locating surfaces is performed prior to performance of said step of placing a second plurality of mold wall sections in the mold fixture.

6. A method as set forth in claim 1 wherein said step of providing an adjustable mold fixture includes the step of providing a base and a pluralty of locating surfaces which are disposed above and are spaced apart from said base, said step of placing a second plurality of mold wall sections in the mold fixture includes the step of placing each mold wall section of the second plurality of mold wall sections on one of the locating surfaces with the mold wall sections disposed above and spaced apart from said base to provide access to lower portions of each mold wall section of the second plurality of mold wall sections.

7. A method as set forth in claim 6 wherein each of the plurality of locating surfaces is disposed on the upper end portion of a pin member which extends upwardly from the base of the mold fixture, said step of adjusting the mold fixture includes the step of changing the positions of pin members relative to the base.

8. A method as set forth in claim 1 wherein step of providing mold wall sections includes the steps of providing a plurality of patterns each of which has a surface area with a configuration corresponding to the configuration of a portion of the surface of the article to be cast, covering each of the patterns with a wet coating of ceramic mold material, drying the coating of ceramic mold material, and separating the coating of ceramic mold material from the pattern.

9. A method as set forth in claim 1 wherein said steps of interconnecting the first and second pluralities of mold wall sections both include the step of applying forces to end portions of adjacent mold sections urging the adjacent end portions of the mold sections toward each other.

10. A method of assembling a plurality of molds to cast articles, said method comprising the steps of providing an adjustable mold fixture which is adapted to receive a plurality of mold wall sections, said step of providing an adjustable mold fixture includes the steps of providing a base and providing a plurality of locating members which are connected with the base and are movable relative to the base to adjust the positions of the locating members relative to the base, providing mold wall sections, placing a first plurality of the mold wall sections having predetermined mold cavity wall forming dimensions in the mold fixture to locate the first plurality of mold wall sections relative to each other, said step of placing the first plurality of mold wall sections in the fixture includes placing mold wall sections of the first plurality of mold wall sections in engagement with the locating members, interconnecting the first plurality of mold wall sections to form a first mold, removing the first mold from the mold fixture, casting a first article using the first mold, measuring the first article to determine the extent to which its dimensions deviate from predetermined dimensions, placing a second plurality of mold wall sections having the same predetermined mold cavity wall forming dimensions as corresponding first mold wall sections in the mold fixture to locate the second plurality of mold wall sections relative to each other, said step of placing the second plurality of mold wall sections in the fixture includes the steps of placing mold wall sections of the second plurality of mold wall sections in engagement with the locating members, adjusting the mold fixture to compensate for deviations in the dimensions of the first article from the predetermined dimensions, said step of adjusting the mold fixture to compensate for deviations in the dimensions of the first article including the step of changing the positions of locating members relative to the base, thereafter interconnecting the second plurality of mold wall sections to form a second mold, removing the second mold from the mold fixture, and casting a second article having at least slightly different dimensions than the first article by using the second mold.

11. A method of assembling a plurality of molds to cast articles, said method comprising the steps of providing an adjustable mold fixture which is adapted to receive a plurality of mold wall sections, said step of providing an adjustable mold fixture includes the steps of providing a base and providing a plurality of upstanding pin members which are disposed on the base and are movable relative to the base, providing a plurality of mold wall sections, placing a first plurality of the mold wall sections having predetermined mold cavity wall forming dimensions in the mold fixture to locate the first plurality of mold wall sections relative to each other, said step of placing a first plurality of mold wall sections in the mold fixture includes positioning the first plurality of mold wall sections on upper end portions of upstanding pin members, interconnecting the first plurality of mold wall sections while they are disposed on the upper end portions of the upstanding pin members, removing the first plurality of mold wall sections from the mold fixture, casting a first article using the first plurality of mold wall sections, measuring the first article to determine the extent to which its dimensions deviate from predetermined dimensions, placing a second plurality of mold wall sections having the same predetermined mold cavity wall forming dimensions as corresponding first mold wall sections in the mold fixture to locate the second plurality of mold wall sections relative to each other, said step of placing a second plurality of mold wall sections in the fixture includes positioning the second plurality of mold wall sections on the upper end portions of the upstanding pin members, adjusting the mold fixture to compensate for deviations in the dimensions of the first article from the predetermined dimensions, said step of adjusting the mold fixture to compensate for deviations in the dimensions of the first article includes the step of moving upstanding pin members relative to the base, thereafter, interconnecting the second plurality of mold wall sections while they are on the upper end portions of the upstanding pin members, removing the second plurality of mold wall sections from the mold fixture, and casting a second article having at least slightly different dimensions than the first article by using the second plurality of mold wall sections.

12. A method as set forth in claim 11 wherein said steps of positioning the first and second pluralities of mold wall sections on the pin members each include the step of supporting the mold wall sections above the base on the upstanding pin members.

13. A method as set forth in claim 11 wherein said step of placing the first plurality of mold wall sections in the mold fixture includes the step of locating the first plurality of mold wall sections in a first circular array, said steps of placing a second plurality of mold wall sections in the mold fixture and adjusting the mold fixture include the steps of locating the second plurality of mold wall sections in a second circular array having a dimension which is different from a corresponding dimension of the first circular array.

14. A method of assembling a plurality of molds to cast circular articles, said method comprising the steps of providing an adjustable mold fixture which is adapted to receive a plurality of arcuate mold wall sections, providing arcuate mold wall sections, placing a first plurality of the arcuate mold wall sections having predetermined mold cavity wall forming dimensions in a first circular array in the mold fixture, interconnecting the first plurality of arcuate mold wall sections while they are disposed in the first circular array in the mold fixture, removing the first circular array of mold wall sections from the mold fixture, casting a first circular article using the first circular array of mold wall sections, measuring the first circular article to determine the extent to which its dimensions deviate from predetermined dimensions, placing a second plurality of arcuate mold wall sections having the same predetermined mold cavity wall forming dimensions as corresponding first mold wall sections in a second circular array in the mold fixture, adjusting the mold fixture to compensate for deviations in the dimensions of the first circular article from the predetermined dimensions, interconnecting the second plurality of arcuate mold wall sections after performing said step of adjusting the mold fixture and while the second plurality of mold sections are disposed in the second circular array in the mold fixture, removing the second circular array of mold wall sections from the mold fixture, and casting a second circular article having at least slightly different dimensions than the first circular article by using the second circular array of mold wall sections.

15. A method as set forth in claim 14 wherein said step of providing an adjustable mold fixture includes the step of providing a base and a plurality of upstanding pin members which are disposed in a circular array on the base, said step of placing a first plurality of arcuate mold wall sections in a first circular array in the mold fixture includes positioning the first plurality of arcuate mold wall sections in engagement with the upstanding pin members, said step of adjusting the mold fixture includes moving upstanding pin members relative to said base, said step of placing a second plurality of arcuate mold wall sections in a second circular array in the mold fixture includes positioning the second plurality of arcuate mold wall sections in engagement with the upstanding pin members and maintaining the second plurality of arcuate mold wall sections in engagement with the pin members while performing said step of interconnecting the second plurality of arcuate mold wall sections.

16. A method as set forth in claim 15 further including the steps of supporting the first plurality of arcuate mold wall sections above the base on the upstanding pin members while performing said step of interconnecting the first plurality of arcuate mold wall sections and supporting the second plurality of arcuate mold wall sections above the base on the upstanding pin members while performing said step of interconnecting the second plurality of arcuate mold wall sections.

17. A method of assembling a plurality of molds to cast articles, said method comprising the steps of providing an adjustable mold fixture which is adapted to receive a plurality of mold wall sections, said step of providing an adjustable mold fixture includes the steps of providing a base and providing a plurality of upstanding pin members which are disposed in a circular array on the base and are rotatable about axes which are offset from central axes of the pin members, providing a plurality of arcuate mold wall sections, placing a first plurality of the mold wall sections in the mold fixture to locate the first plurality of mold wall sections relative to each other, said step of placing a first plurality of mold wall sections in the mold fixture includes positioning the first plurality of mold wall sections in a circular array on the pin members, interconnecting the first plurality of mold wall sections while they are disposed on the pin members in the mold fixture to form a first mold, removing the first mold from the mold fixture, casting a first article using the first mold, measuring the first article to determine the extent to which its dimensions deviate from predetermined dimensions, placing a second plurality of arcuate mold wall sections in the mold fixture to locate the second plurality of mold wall sections relative to each other, said step of placing a second plurality of mold wall sections in the fixture includes positioning the second plurality of mold wall sections in a circular array on the pin members, adjusting the mold fixture to compensate for deviations in the dimensions of the first article from the predetermined dimensions, said step of adjusting the mold fixture to compensate for deviations in the dimensions of the first article includes the step of rotating the pin members about axes which are offset from the central axes of the pin members to adjust the positions of the pin members relative to the base, interconnecting the second plurality of mold wall sections while they are in the mold fixture to form a second mold, removing the second mold from the mold fixture, and casting a second article having at least slightly different dimensions than the first article by using the second mold.

18. A method as set forth in claim 17 wherein said steps of positioning the first and second pluralities of mold wall sections in circular arrays on the pin members includes the steps of engaging upper end portions of the pin members with the mold wall sections to support the mold wall sections above the base.

19. A method as set forth in claim 17 wherein said step of placing the first plurality of mold wall sections in the mold fixture includes the step of locating the first plurality of mold wall sections in a circular array having a first diameter, said steps of placing a second plurality of mold wall sections in the mold fixture and adjusting the mold fixture include the step of locating the second plurality of mold wall sections in a second circular array having a second diameter which is different than said first diameter.

20. A method of assembling a plurality of molds to cast articles, said method comprising the steps of providing an adjustable mold fixture which is adapted to receive a plurality of mold wall sections, said step of providing an adjustable mold fixture includes the step of providing a base and a plurality of locating surfaces which are disposed above and are spaced apart from said base, each of the plurality of locating surfaces being disposed on the upper end portion of a pin member which extends upwardly from the base of the mold fixture, providing mold wall sections, placing a first plurality of the mold wall sections in the mold fixture to locate the first plurality of mold wall sections relative to each other, interconnecting the first plurality of mold wall sections while they are in the mold fixture to form a first mold, removing the first mold from the mold fixture, casting a first article using the first mold, measuring the first article to determine the extent to which its dimensions deviate from predetermined dimensions, placing a second plurality of mold wall sections in the mold fixture to locate the second plurality of mold wall sections relative to each other, said step of placing a second plurality of mold wall sections in the mold fixture includes the step of placing the second plurality of mold wall sections on the locating surfaces with the mold wall sections disposed above and spaced apart from said base to provide access to lower portions of the second plurality of mold wall sections, adjusting the mold fixture to compensate for deviations in the dimensions of the first article from the predetermined dimensions, said step of adjusting the mold fixture includes the step of changing the positions of pin members relative to the base, said step of changing the positions of the pin members includes the step of rotating the pin members relative to the base about axes which are offset from central axes of the pin members, interconnecting the second plurality of mold wall sections while they are in the mold fixture to form a second mold, removing the second mold from the mold fixture, and casting a second article having at least slightly different dimensions that the first article by using the second mold.

21. A method of assembling a plurality of molds to cast articles, said method comprising the steps of providing an adjustable mold fixture which is adapted to receive a plurality of mold wall sections, providing mold wall sections, placing a first plurality of the mold wall sections in the mold fixture to locate the first plurality of mold wall sections relative to each other, interconnecting the first plurality of mold wall sections while they are in the mold fixture to form a first mold, removing the first mold from the mold fixture, casting a first article using the first mold, measuring the first article to determine the extent to which its dimensions deviate from predetermined dimensions, placing a second plurality of mold wall sections in the mold fixture to locate the second plurality of mold wall sections relative to each other, each mold section of the second plurality of mold wall sections having a size and configuration which are the same as the size configuration of a mold wall section of the first plurality of mold wall sections, adjusting the mold fixture to compensate for deviations in the dimensions of the first article from the predetermined dimensions, thereafter, interconnecting the second plurality of mold wall sections while they are in the mold fixture to form a second mold which is of a different overall size than the first mold, removing the second mold from the mold fixture, and casting a second article having different dimensions than the first article by using the second mold.

22. A method as set forth in claim 21 wherein said step of adjusting the mold fixture is performed prior to the performance of said step of placing a second plurality of mold wall sections in the mold fixture.

23. A method as set forth in claim 21 wherein said step of placing the first plurality of mold wall sections in the mold fixture includes the step of locating the first plurality of mold wall sections in a circular array having a first diameter, said steps of placing a second plurality of mold wall sections in the mold fixture and adjusting the mold fixture includes the step of locating the second plurality of mold wall sections in a second circular array having a second diameter which is different than said first diameter.

24. A method as set forth in claim 23 wherein said step of providing an adjustable mold fixture includes the step of providing a mold fixture having a plurality of mold wall locating surfaces which are disposed in a circular array, said step of adjusting the mold fixture including the step of changing the diameter of the circular array of mold wall locating surfaces.

25. A method as set forth in claim 24 wherein said step of changing the diameter of the circular array of mold wall locating surfaces includes the step of rotating locating surfaces about axes which are offset from central axes of the locating surfaces.

26. A method as set forth in claim 21 wherein said step of providing an adjustable mold fixture includes the step of providing a base and a plurality of locating surfaces which are disposed above and are spaced apart from said base, said step of placing a second plurality of mold wall sections in the mold fixture includes the step of placing the second plurality of mold wall sections on the locating surfaces with the mold wall sections disposed above and spaced apart from said base to provide access to lower portions of the second plurality of mold wall sections.

27. A method as set forth in claim 26 wherein each of the plurality of locating surfaces is disposed on the upper end portion of a pin member which extends upwardly from the base of the mold fixture, said step of adjusting the mold fixture includes the step of changing the positions of pin members relative to the base.

28. A method as set forth in claim 27 wherein said step of changing the positions of the pin members includes the step of rotating the pin members relative to the base about axes which are offset from central axes of the pin members.

29. A method of assembling a plurality of molds to cast articles, said method comprising the steps of providing an adjustable mold fixture which is adapted to receive a plurality of mold wall sections, said step of providing an adjustable mold fixture includes the step of providing a base having a plurality of upwardly extending pin members, providing mold wall sections, placing a first plurality of the mold wall sections in the mold fixture to locate the first plurality of mold wall sections relative to each other, said step of placing a first plurality of mold wall sections in the mold fixture includes the step of placing the first plurality of mold wall sections in engagement with the pin members, interconnecting the first plurality of mold wall sections while they are in engagement with the pin members, removing the first plurality of mold wall sections from the mold fixture, casting a first article using the first plurality of mold wall sections, measuring the first article to determine the extent to which its dimensions deviate from predetermined dimensions, placing a second plurality of mold wall sections in the mold fixture to locate the second plurality of mold wall sections relative to each other, said step of placing a second plurality of mold wall sections in the mold fixture includes the step of placing the second plurality of mold wall sections in engagement with the pin members, adjusting the mold fixture to compensate for deviations in the dimensions of the first article from the predetermined dimensions, said step of adjusting the mold fixture includes the step of rotating pin members relative to the base about axes which are offset from central axes of the pin members, thereafter, interconnecting the second plurality of mold wall sections while they are in engagement with the pin members, removing the second plurality of mold wall sections from the mold fixture, and casting a second article having at least slightly different dimensions that the first article by using the second plurality of mold wall sections.

30. A method of assembling a plurality of molds to cast articles, said method comprising the steps of providing an adjustable mold fixture which is adapted to receive a plurality of mold wall sections, said step of providing an adjustable mold fixture includes the steps of providing a base and providing a plurality of upstanding pin members which are disposed on the base and are movable relative to the base, providing a plurality of mold wall sections, placing a first plurality of the mold wall sections in the mold fixture to locate the first plurality of mold wall sections relative to each other, said step of placing a first plurality of mold wall sections in the mold fixture includes positioning the first plurality of mold wall sections on upper end portions of upstanding pin members, interconnecting the first plurality of mold wall sections while they are disposed on the upper end portions of the upstanding pin members, removing the first plurality of mold wall sections from the mold fixture, casting a first article using the first plurality of mold wall sections, measuring the first article to determine the extent to which its dimensions deviate from predetermined dimensions, placing a second plurality of mold wall sections in the mold fixture to locate the second plurality of mold wall sections relative to each other, said step of placing a second plurality of mold wall sections in the fixture includes positioning the second plurality of mold wall sections on the upper end portions of the upstanding pin members, adjusting the mold fixture to compensate for deviations in the dimensions of the first article from the predetermined dimensions, said step of adjusting the mold fixture to compensate for deviations in the dimensions of the first article includes the step of moving upstanding pin members relative to the base, said step of moving upstanding pin members includes the step of rotating upstanding pin members about axes which are offset from central axes of the pin members, thereafter, interconnecting the second plurality of mold wall sections while they are on the upper end portions of the upstanding pin members, removing the second plurality of mold wall sections from the mold fixture, and casting a second article having at least slightly different dimensions than the first article by using the second plurality of mold wall sections.

31. A method of assembling a plurality of molds to cast circular articles, said method comprising the steps of providing an adjustable mold fixture which is adapted to receive a plurality of arcuate mold wall sections, said step of providing an adjustable mold fixture includes the step of providing a base and a plurality of upstanding pin members which are disposed in a circular array on the base, providing arcuate mold wall sections, placing a first plurality of the arcuate mold wall sections in a first circular array in the mold fixture, said step of placing a first plurality of arcuate mold wall sections in a first circular array in the mold fixture includes positioning the first plurality of arcuate mold wall sections in engagement with the upstanding pin members, interconnecting the first plurality of arcuate mold wall sections while they are disposed in the first circular array in the mold fixture, removing the first circular array of mold wall sections from the mold fixture, casting a first circular article using the first circular array of mold wall sections, measuring the first circular article to determine the extent to which its dimensions deviate from predetermined dimensions, placing a second plurality of arcuate mold wall sections in a second circular array in the mold fixture, said step of placing a second plurality of arcuate mold wall sections in a second circular array in the mold fixture includes positioning the second plurality of arcuate mold wall sections in engagement with the upstanding pin members and maintaining the second plurality of arcuate mold wall sections in engagement with the pin members while performing said step of interconnecting the second plurality of arcuate mold wall sections, adjusting the mold fixture to compensate for deviations in the dimensions of the first circular article from the predetermined dimensions, said step of adjusting the mold fixture includes moving upstanding pin members relative to said base, said step of moving upstanding pin members includes the step of rotating upstanding pin members about axes which are offset from central axes of the pin members, interconnecting the second plurality of arcuate mold wall sections after performing said step of adjusting the mold fixture and while the second plurality of mold sections are disposed in the second circular array in the mold fixture, removing the second circular array of mold wall sections from the mold fixture, and casting a second circular article having at least slightly different dimensions than the first circular article by using the second circular array of mold wall sections.

* * * * *

UNITED STATES PATENT AND TRADEMARK OFFICE

CERTIFICATE OF CORRECTION

PATENT NO. : 4,224,976

DATED : September 30, 1980

INVENTOR(S) : William S. Blazek

It is certified that error appears in the above-identified patent and that said Letters Patent are hereby corrected as shown below:

Column 14, line 51, please delete "that" and insert thereat --than--.

Column 16, line 27, please delete "that" and insert thereat --than--.

Signed and Sealed this

*Third* Day of *March 1981*

[SEAL]

*Attest:*

RENE D. TEGTMEYER

*Attesting Officer*

*Acting Commissioner of Patents and Trademarks*